US009368864B2

(12) United States Patent
Wakabayashi et al.

(10) Patent No.: US 9,368,864 B2
(45) Date of Patent: Jun. 14, 2016

(54) ANTENNA DEVICE AND ELECTRONIC APPARATUS USING IT

(71) Applicant: Sony Computer Entertainment Inc., Tokyo (JP)

(72) Inventors: Minoru Wakabayashi, Tokyo (JP); Yoshio Miyazaki, Kanagawa (JP)

(73) Assignees: Sony Corporation, Tokyo (JP); Sony Interactive Entertainment Inc., Tokyo (JP)

( * ) Notice: Subject to any disclaimer, the term of this patent is extended or adjusted under 35 U.S.C. 154(b) by 140 days.

(21) Appl. No.: 14/289,882

(22) Filed: May 29, 2014

(65) Prior Publication Data

US 2014/0368399 A1 Dec. 18, 2014

(30) Foreign Application Priority Data

Jun. 13, 2013 (JP) ..... 2013-124974

(51) Int. Cl.
*H01Q 1/52* (2006.01)
*H01Q 1/24* (2006.01)

(52) U.S. Cl.
CPC ..... *H01Q 1/52* (2013.01); *H01Q 1/243* (2013.01); *H01Q 1/245* (2013.01); *H01Q 1/526* (2013.01)

(58) Field of Classification Search
CPC ..... H01Q 1/52; H01Q 1/526; H01Q 1/245; H01Q 1/242; H01Q 1/243
USPC ..... 343/841, 702
See application file for complete search history.

(56) References Cited

U.S. PATENT DOCUMENTS

| | | | | |
|---|---|---|---|---|
| 6,469,670 | B2 | 10/2002 | Ito | |
| 7,002,521 | B2 | 2/2006 | Egawa | |
| 7,468,708 | B2 | 12/2008 | Park et al. | |
| 7,554,496 | B2 * | 6/2009 | Qi | H01Q 1/245 343/702 |
| 8,305,274 | B2 * | 11/2012 | Shim | H01Q 1/243 343/702 |
| 8,502,741 | B2 * | 8/2013 | Lin | H01Q 1/243 343/700 MS |
| 2002/0014994 | A1 | 2/2002 | Ito | |
| 2004/0130492 | A1 | 7/2004 | Egawa | |
| 2008/0001831 | A1 | 1/2008 | Park | |
| 2010/0245178 | A1 | 9/2010 | Hsieh | |

FOREIGN PATENT DOCUMENTS

| | | | |
|---|---|---|---|
| EP | 2099093 | A1 | 9/2009 |
| JP | 2002026627 | A | 1/2002 |
| JP | 2003258523 | A | 9/2003 |
| JP | 2007067512 | | 3/2007 |
| JP | 2008017485 | A | 1/2008 |
| JP | 2010233218 | A | 10/2010 |
| JP | 2013516833 | T | 5/2013 |
| WO | 2011081630 | A1 | 7/2011 |

* cited by examiner

OTHER PUBLICATIONS

Office Action for corresponding JP Application No. 2013124974, dated Mar. 24, 2015.

*Primary Examiner* — Hoang V Nguyen
(74) *Attorney, Agent, or Firm* — Matthew B. Dernier, Esq.

(57) ABSTRACT

An antenna device includes a ground conductor, a radiation conductor having a feed point, and a guard conductor that is insulated from the ground conductor and is disposed at a position that is closer to a specific site of a user than the radiation conductor in one use form and is such a position that at least part of the guard conductor overlaps with a place where the intensity of an electric field radiated from the radiation conductor is high.

14 Claims, 14 Drawing Sheets

ANTENNA DEVICE AND ELECTRONIC APPARATUS USING IT

BACKGROUND

The present disclosure relates to an antenna device.

In recent years, various pieces of electronic apparatus such as mobile phones, tablet terminals, and mobile game machines have come to be equipped with wireless communication functions. Because these pieces of apparatus are used near a human body in a telephone call and data transfer, there has been concern about influence of radio waves on the human body. In Japan, in consideration of this concern, the specific absorption rate (SAR), which is the amount of energy absorbed by the human body, is defined by law about radio waves radiated by mobile phones and so forth.

The SAR is the average of the amount of energy absorbed by the human body of unit mass per unit time, and two criteria, whole-body SAR and local SAR, are defined. The SAR is defined by the following calculation formula.

$$SAR=\sigma|E|2/\rho$$

E: electric field intensity [V/M]

σ: conductivity of human body tissue [S/m]

ρ: density of human body tissue [kg/m$^3$]

Regarding the local SAR, a criterion is defined on each country basis. For example, in Japan, the average of energy absorbed per 10 g of human tissue in six minutes is restricted to at most 2 W/kg. In the US, it is restricted to at most 1.6 W/kg per 1 g of human tissue. To meet the SAR criterion in each country, various techniques have been proposed.

One of them is a method in which transmission power from an antenna is lowered when the approximation of a human body to the terminal is detected by using a proximity sensor or the like. However, this method is not preferable because energy radiated from the terminal is reduced and thus the communication performance is sacrificed.

Techniques for reducing the SAR without changing the transmission power have been proposed in Japanese Patent Laid-opens No. 2003-258523, No. 2007-67512, and No. 2002-26627 (Patent Documents 1 to 3). In the techniques described in Patent Documents 1 to 3, the directionality of a radiation pattern from an antenna is aggressively changed to reduce electromagnetic waves radiated in a specific direction in which a human body exists. These techniques are effective in electronic apparatus, such as a mobile phone terminal, used with keeping of a specific positional relationship with a human body in a telephone call.

SUMMARY

However, the techniques described in Patent Documents 1 to 3 are difficult to employ for electronic apparatus involving a variety of changes in the positional relationship between the electronic apparatus and the human body. Examples of electronic apparatus used in various forms include smartphones, tablet terminals, mobile game machines, and wireless controllers of stationary game consoles. FIGS. 1A and 1B are diagrams showing examples of the positional relationship between a user and electronic apparatus. In FIG. 1A, a user 200 uses electronic apparatus 100 with the electronic apparatus 100 located over and near a thigh. In FIG. 1B, the user 200 grasps the electronic apparatus 100 in front of the user 200.

In the electronic apparatus involving changes in the use form, the criterion of the SAR needs to be met in the use form of FIG. 1A. Therefore, the directionality of the antenna needs to be so designed that an electromagnetic field in a direction D1 from the electronic apparatus 100 toward the thigh, i.e. an electromagnetic field oriented in the vertical direction from the back surface of the chassis, is reduced. However, when used in the form of FIG. 1B, the antenna in which the directionality in the direction D1 is weakened cannot radiate an electromagnetic field in the front direction D1. Furthermore, there is a problem that the reception sensitivity to an electromagnetic field from the front direction D1 is lowered. In particular, in an environment in which reflected waves are dominant, such as a room inside, the lowering of the reception sensitivity of a specific direction possibly leads directly to the lowering of the communication quality.

In electronic apparatus whose use form changes as shown in FIGS. 1A and 1B, an antenna device for which only the near field in a specific direction is suppressed without suppressing the far field (radiation field) in this direction is desired.

There is a need for the present disclosure to provide an antenna device capable of suppressing the SAR without sacrificing the antenna sensitivity and the directionality.

According to an embodiment of the present disclosure, there is provided an antenna device. The antenna device includes a ground conductor, a radiation conductor configured to have a feed point, and a guard conductor configured to be insulated from the ground conductor and be disposed at a position that is closer to a specific site of a user than the radiation conductor in one use form and straddles one side of the ground conductor closest to the feed point or a virtual extended line of the one side.

The present inventor has found the following. Specifically, a current flows in a concentrated manner in the vicinity of one side closest to the feed point in the ground conductor. Therefore, there is a tendency that the electric field intensity at the periphery of the one side is high and there is a tendency that the electric field intensity is high also in the vicinity of an extended line of the one side. According to this embodiment, by disposing the guard conductor in such a manner that at least part of the guard conductor overlaps with a place where there is a high probability that the electric field intensity is high, the concentrated electric field can be dispersed to the outer periphery of the guard conductor and the local SAR can be reduced. Furthermore, the guard conductor intensely acts on the near field and does not have a very large influence on the far field. Therefore, the local SAR can be suppressed without sacrificing the antenna sensitivity and the directionality.

When the wavelength of an electric field radiated from the antenna device is defined as λ, the length of a long side of the guard conductor may be shorter than λ/2. Alternatively, the length of the long side of the guard conductor may be a non-integer multiple of λ/2.

The "wavelength" is the effective wavelength and can be a wavelength $\lambda'=\lambda/\sqrt{\in r}$, defined in consideration of a wavelength compression effect by a dielectric. ∈r is the relative dielectric constant of the dielectric.

This can prevent the guard conductor from acting as a radiation conductor and reduce the influence of the guard conductor on the directionality of the antenna device.

The guard conductor may be disposed at such a position that at least part of the guard conductor overlaps with one of a first area in the vicinity of an open end of the radiation conductor, a second area in the vicinity of a virtual point resulting from symmetric displacement of the open end with respect to the feed point, and a third area sandwiched between the first area and the second area.

The "vicinity" possibly includes a range of about 20% of the wavelength ($\lambda/5$) for example.

When the wavelength of an electric field radiated from the antenna device is defined as $\lambda$, the guard conductor may be disposed at such a position that at least part of the guard conductor overlaps with part of a range with a radius of $\lambda/5$ centered at the open end of the radiation conductor.

When the wavelength of an electric field radiated from the antenna device is defined as $\lambda$, the guard conductor may be disposed at such a position that at least part of the guard conductor overlaps with part of a range with a radius of $\lambda/5$ centered at a virtual point resulting from symmetric displacement of the open end with respect to the feed point.

One surface of a chassis of electronic apparatus equipped with the antenna device may be close to or in contact with the specific site in the one use form. The distance between the guard conductor and the radiation conductor along a direction perpendicular to the one surface may be at most $\lambda/(2\pi)$.

This can effectively cancel out the near field.

The guard conductor may have a long side along a direction perpendicular to the one side of the ground conductor.

A plurality of radiation conductors may be included. The guard conductor may be provided for the radiation conductor that radiates an electric field with the shortest wavelength.

According to another embodiment of the present disclosure, there is provided an antenna device, too. This antenna device includes a ground conductor, a radiation conductor configured to have a feed point, and a guard conductor configured to be insulated from the ground conductor and be disposed at a position that is closer to a specific site of a user than the radiation conductor in one use form and is such a position that at least part of the guard conductor overlaps with a place where the intensity of an electric field radiated from the radiation conductor is high unless the guard conductor is provided.

According to another embodiment of the present disclosure, there is provided electronic apparatus. The electronic apparatus includes an antenna device including a ground conductor, a radiation conductor configured to have a feed point, and a guard conductor configured to be insulated from the ground conductor and be disposed at a position that is closer to a specific site of a user than the radiation conductor in one use form and straddles one side of the ground conductor closest to the feed point or a virtual extended line of the one side.

What are obtained by translating arbitrary combinations of the above-described constituent elements and expressions of the present disclosure among method, device, system, and so forth are also effective as embodiments of the present disclosure.

According to the embodiments of the present disclosure, the SAR can be suppressed without sacrificing the antenna sensitivity and the directionality.

DETAILED DESCRIPTION OF THE PREFERRED EMBODIMENT

A preferred embodiment of the present disclosure will be described below with reference to the drawings. The same or equivalent constituent element, member, and processing shown in the respective drawings are given the same symbol and overlapping description will be properly omitted. Furthermore, the embodiment does not limit the disclosure and is exemplification and all characteristics described in the embodiment and combinations thereof are not necessarily essential ones of the disclosure.

In the present specification, a "state in which a member A is connected to a member B" encompasses a case in which the member A and the member B are indirectly connected with the intermediary of another member having no influence on the electrical connection state as well as a case in which the member A and the member B are directly connected physically.

Similarly, a "state in which a member C is provided between a member A and a member B" encompasses a case in which the member A and the member C or the member B and the member C are indirectly connected with the intermediary of another member having no influence on the electrical connection state as well as a case in which they are directly connected.

Figure 1A:
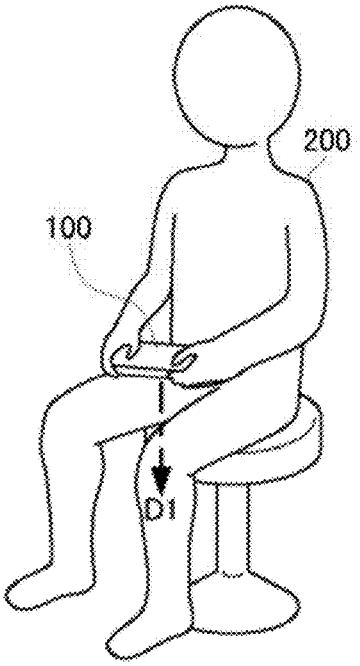
FIGS. 1A and 1B are diagrams showing examples of the positional relationship between a user and electronic apparatus.
Figure 1B:
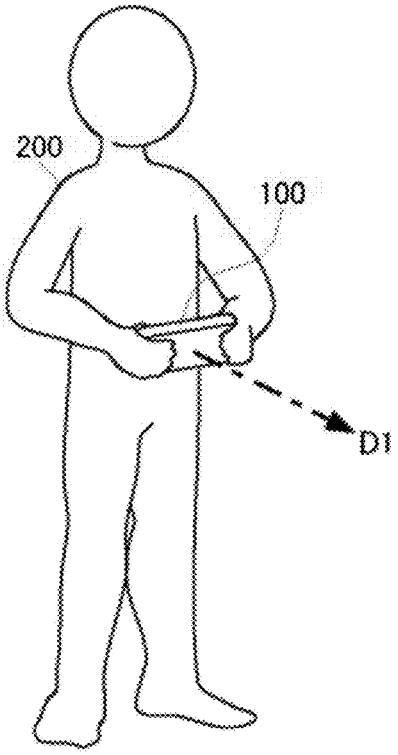
Figure 2A:
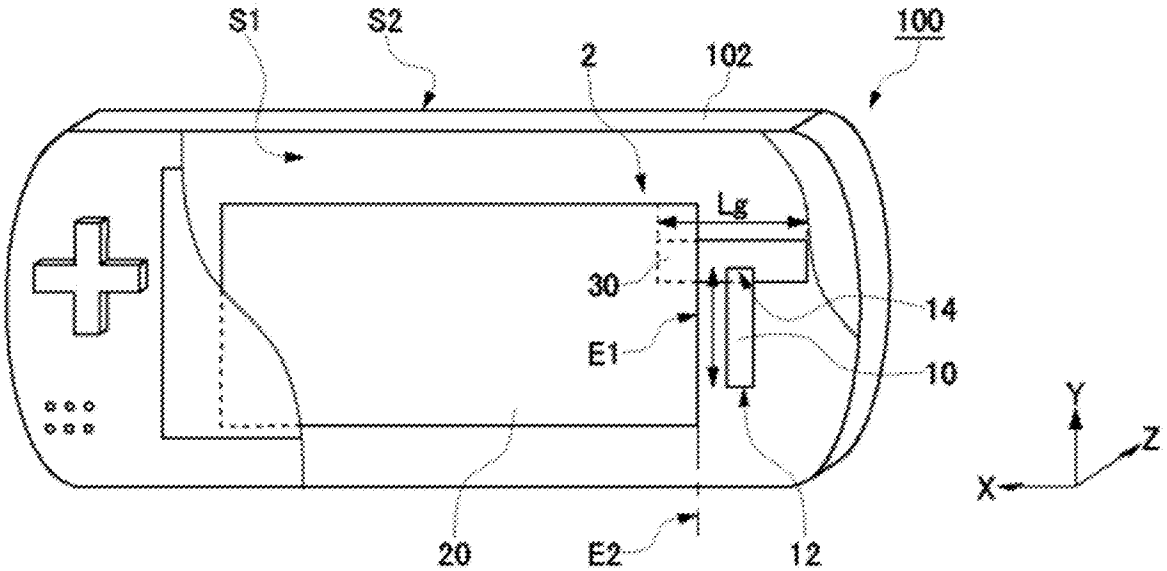
FIGS. 2A and 2B are perspective views showing electronic apparatus including an antenna device according to an embodiment of the present disclosure.
Figure 2B:
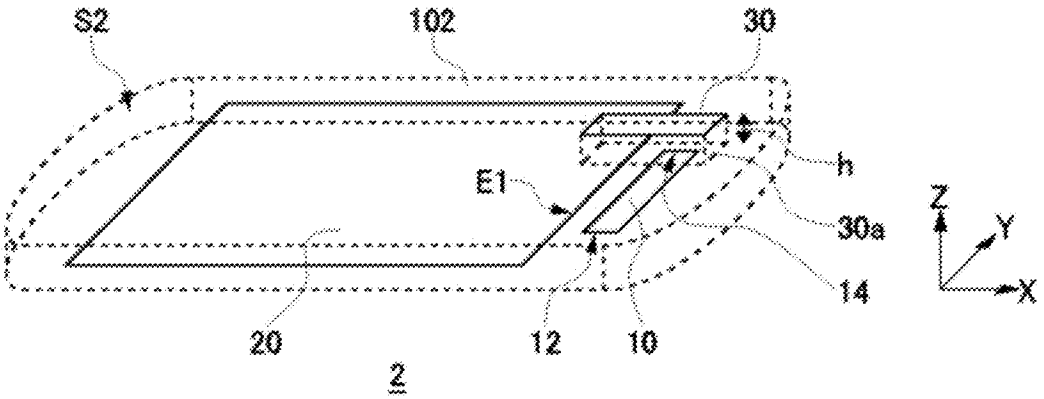

FIGS. 2A and 2B are perspective views showing electronic apparatus 100 including an antenna device 2 according to the embodiment. The antenna device 2 is incorporated in the electronic apparatus 100. In use of the electronic apparatus 100, the positional relationship between the electronic apparatus 100 and a human body (user 200) variously changes as shown in FIGS. 1A and 1B. Examples of the electronic apparatus 100 include smartphones, tablet terminals, and mobile game machines.

Hereinafter, for facilitation of understanding and simplification of explanation, the horizontal direction of a chassis (exterior package) 102 of the electronic apparatus 100 will be defined as the X-direction. Furthermore, the vertical direction and the thickness direction will be defined as the Y-direction and the Z-direction, respectively. One surface of the chassis 102 on the front side will be referred to as a front surface S1 and the opposite surface will be referred to as a back surface S2.

In certain one use form, the back surface S2 of the electronic apparatus 100 is in contact with or close to a specific site of a human body, specifically e.g. a thigh. Therefore, it is preferable for the electronic apparatus 100 to suppress the SAR regarding an electromagnetic field radiated in the Z-direction from the back surface S2 toward the specific site.

Figure 3B:
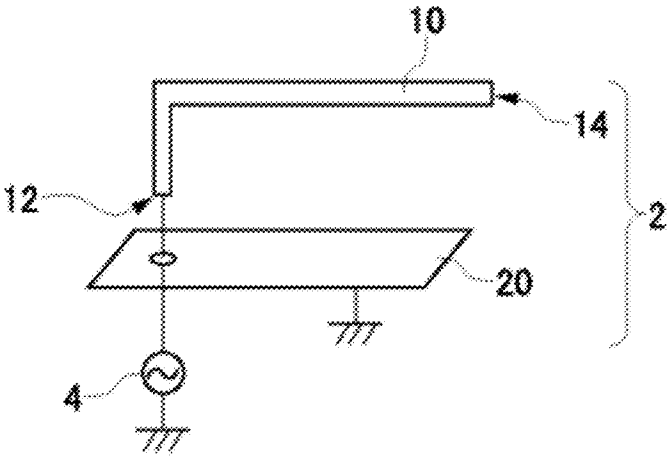
FIGS. 3A and 3B are diagrams showing configuration examples of the antenna device.
Figure 3A:
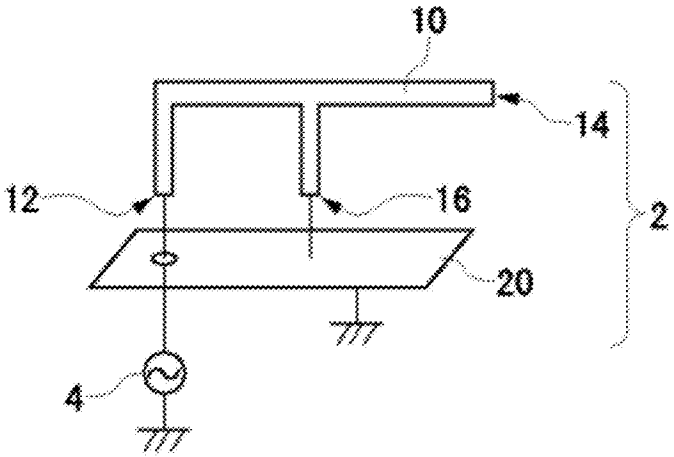

Prior to explanation of the details of the structure of the antenna device 2, its basic configuration will be described. FIGS. 3A and 3B are diagrams showing configuration examples of the antenna device 2. The antenna device 2 of FIG. 3A is an inverted-F antenna and includes a radiation conductor 10 and a ground conductor 20. The radiation conductor 10 has a feed point 12, an open end 14, and a ground end 16. An AC (alternating current) signal is applied from a feed element 4 to the feed point 12 and the ground end 16 is connected to the ground conductor 20.

The antenna device 2 of FIG. 3B is an L-antenna and includes the radiation conductor 10 and the ground conductor 20. In the L-antenna, the ground end 16 does not exist and the radiation conductor 10 is not short-circuited to the ground conductor 20.

The antenna device 2 may be the antenna device shown in FIG. 3A or 3B or may be an antenna of another form.

In the antenna device 2, the shape of the radiation conductor 10 is not particularly limited and it has a bar shape, flat plate shape, meander shape, spiral shape, etc. The antenna device 2 may be disposed in a two-dimensional plane or may be disposed in a three-dimensional space. Similarly, the shape of the ground conductor 20 is also not particularly limited.

Referring back to FIG. 2A, the antenna device 2 includes a guard conductor 30 in addition to the radiation conductor 10 and the ground conductor 20.

The radiation conductor 10 and the ground conductor 20 are incorporated in the chassis 102 of the electronic apparatus 100. The ground conductor 20 may be a pattern that is formed on a printed board, a flexible board, or the chassis 102 and has electrical conductivity or may be a metal plate. Alternatively, the ground conductor 20 may be an arbitrary combination of pattern and metal plate electrically connected to each other. In FIGS. 2A and 2B, the ground conductor 20 is shown as a single rectangular flat plate in a simplified manner.

The radiation conductor 10 also may be a pattern that is formed on a printed board, a flexible board, or the chassis 102 and has electrical conductivity or may be a metal plate, metal piece, or metal bar. In FIGS. 2A and 2B, the radiation conductor 10 is shown as a rectangular flat plate in a simplified manner.

The guard conductor 30 is disposed at a position closer to a specific site of a human body than the radiation conductor 10 and the ground conductor 20 in one use form. The "specific site" means a human body site for which the influence of the SAR should be considered in one use form. In the use form of FIG. 1A, the specific site is a thigh of the user 200. The guard conductor 30 is disposed at a position separate from the radiation conductor 10 in the Z-axis direction. This guard conductor 30 is insulated from the ground conductor 20 and is in an electrically floating state.

For example, the guard conductor 30 is a conductor plate attached to the back surface S2. The guard conductor 30 may be a metal object provided exclusively for the purpose of SAR reduction. For example, the guard conductor 30 may be a copper sheet.

Alternatively, a metal object that is a component mounted in the electronic apparatus 100 for another purpose and is cut from the antenna device 2 in terms of high frequencies, i.e. a metal object whose impedance with respect to the antenna device 2 is sufficiently high in the high frequency band, may be diverted as the guard conductor 30. Such a metal object may be insulated from the antenna device 2 or may be cut in terms of high frequencies by inserting an inductor between them. For example, normally a plate metal or sheet for heat release and a proximity sensor pad to detect the approximation of a human body exist near the chassis 102 of a mobile terminal. So, these components can be used as the guard conductor 30 by cutting them in terms of high frequencies. Alternatively, the guard conductor 30 may be formed by using electrically-conductive paint used for the exterior package of a mobile terminal.

The guard conductor 30 is disposed at such a position as to straddle one side E1 closest to the feed point 12 among the sides of the ground conductor 20. In FIG. 2B, a projection 30*a* of the guard conductor 30 to the plane including the radiation conductor 10 is indicated by a dashed line and this projection 30*a* overlaps with the one side E1. As described later, the guard conductor 30 may be so disposed as to straddle a virtual extended line (one-dot chain line) E2 of the one side E1.

When the length Lg of the guard conductor 30 is λ/2 or longer, the guard conductor 30 acts as a radiation conductor in some cases and therefore possibly the function to suppress the SAR is lowered or the directionality of the antenna device 2 is affected. So, it is preferable that the length Lg of the guard conductor 30 be shorter than λ/2.

The above is the basic configuration of the antenna device 2. Next, its principle will be explained.

An electric field generated from the antenna device 2 is represented as expression (1) with use of distance r from the antenna.

$$E_\gamma(\gamma,\theta,\psi)=\frac{Il}{2\pi}e^{-jk\gamma}k^2\eta\left(\frac{1}{(k\gamma)^2}-\frac{j}{(k\gamma)^3}\right)\cos\theta \qquad \text{[Expression 1]}$$

$$E_\theta(\gamma,\theta,\psi)=\frac{Il}{4\pi}e^{-jk\gamma}k^2\eta\left(\frac{j}{k\gamma}+\frac{1}{(k\gamma)^2}-\frac{j}{(k\gamma)^3}\right)\sin\theta$$

I: amplitude
l: antenna length
k: propagation constant
η: wave impedance

In general, the area closer to the antenna is referred to as the near field and the area remoter from the antenna is referred to as the far field, with the boundary being the distance r satisfying kr=1, i.e. distance r=λ/(2π). At a place particularly close to the antenna in the near field, an electric field based on the term of $1/r^3$ is dominant. The present inventor has paid attention to that this near filed is dominant for the local SAR, and has reached recognition of that the local SAR can be reduced by suppressing electric field concentration in the near field. Therefore, it is preferable that the distance between the guard conductor 30 and the open end 14 along the direction perpendicular to one surface (back surface S2) of the chassis 102, in other words, the distance along the direction perpendicular to the surface of the specific site, in more other words, separation distance h along the Z-direction, be set to λ/(2π) or shorter. This can cancel out only the near field without causing the guard conductor 30 to act on the far field.

The near field is an electric field causing electrostatic induction. If a conductor is disposed therein, the electric field is cancelled out due to the movement of the charge in the conductor. Based on this principle, the guard conductor 30 plays a role to cancel out part of the electric field generated by the radiation conductor 10.

Subsequently, effects of the antenna device 2 will be explained with reference to simulation results.

Figure 4A:
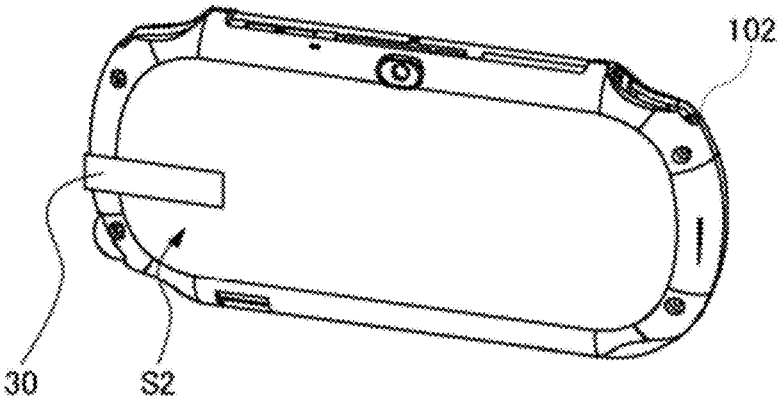
FIGS. 4A and 4B are diagrams showing a model of the antenna device used for simulation.
Figure 4B:
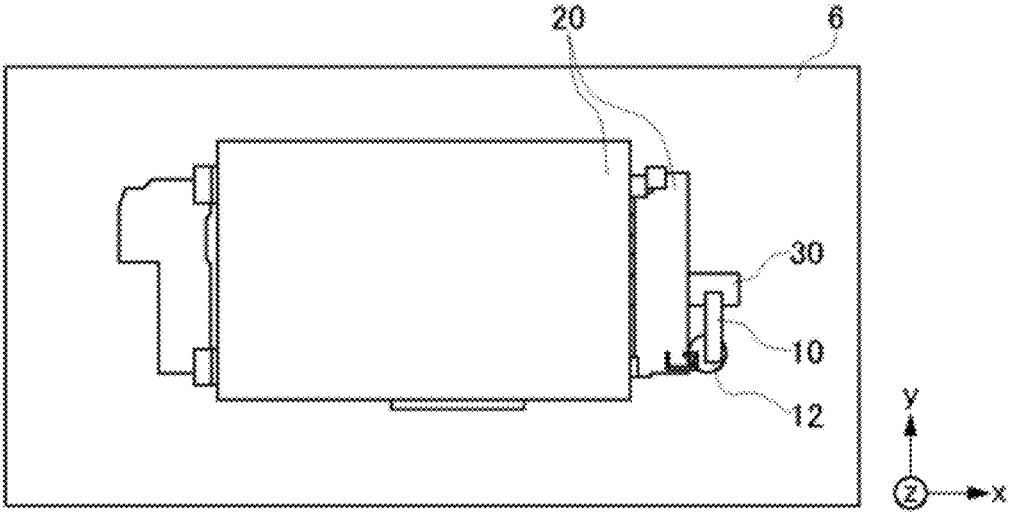

FIGS. 4A and 4B are diagrams showing a model of the antenna device 2 used for the simulation. In FIG. 4B, a model of a phantom 6 mimicking biological tissue is also shown.

Although the antenna device 2 is an inverted-F antenna, the ground end 16 of the radiation conductor 10 and a conductor to connect the ground end 16 to the ground conductor 20 are omitted. The ground conductor 20 is modeled as an object obtained by coupling several conductors. The frequency of an electric field used for the simulation is 2.1 GHz and its wavelength λ is substantially 142 mm. The length of the radiation conductor 10 of the inverted-F antenna is λ/4≈35.5 mm.

FIGS. 5A, 5B, 6A, 6B, 7A, and 7B are each a diagram showing intensity distribution of the electric field generated by the antenna device 2 in a plane parallel to the X- and Y-axes. FIGS. 5 to 7 are different in the distance from the XY-plane (Z-coordinate). FIG. 5 shows distribution obtained near the back surface S2 of the chassis 102. FIG. 6 shows distribution obtained between the back surface S2 and the human body (phantom 6). FIG. 7 shows distribution in the phantom 6. In the respective diagrams, A shows a simulation result when the guard conductor 30 is not provided and B shows one when the guard conductor 30 is provided.

Figure 5A:
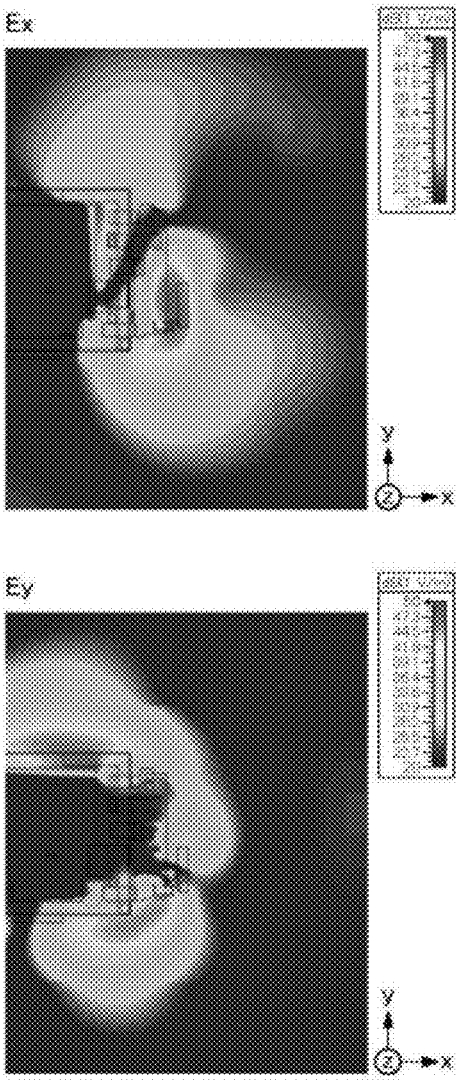
FIGS. 5A and 5B are diagrams showing intensity distribution of an electric field generated by the antenna device in a plane parallel to the X- and Y-axes.

Reference to FIG. 5A proves that, near the antenna device 2, a strong electric field Ex is generated around an area surrounded by the feed point 12, the radiation conductor 10, and the one side E1 of the ground conductor 20.

Figure 5B:
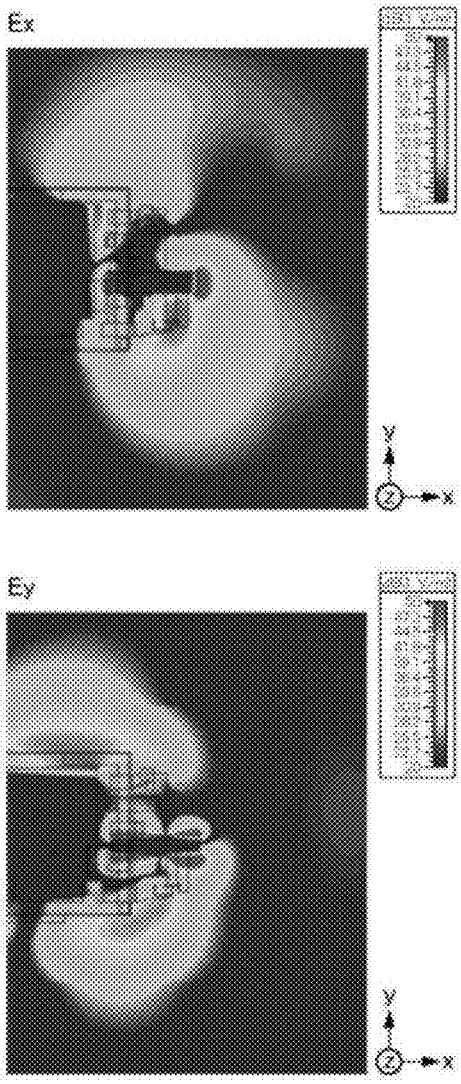
Figure 6A:
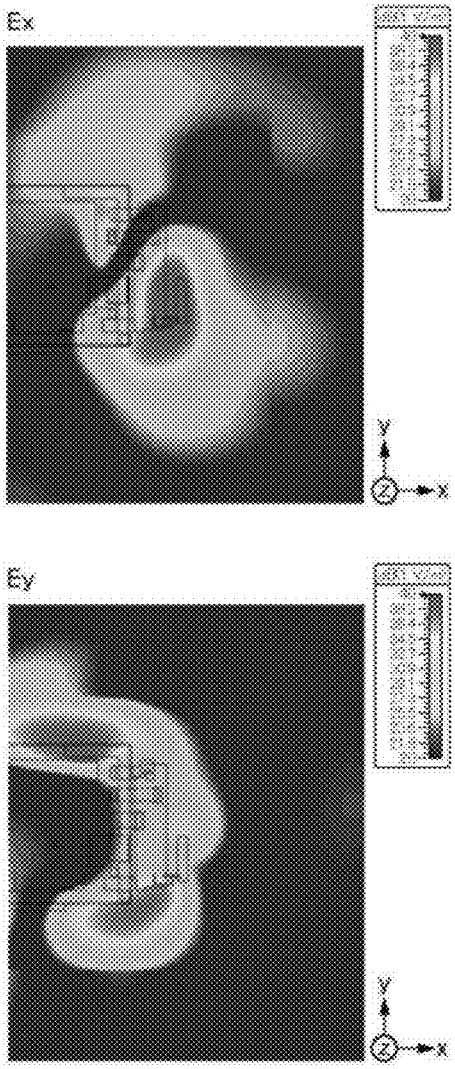
FIGS. 6A and 6B are diagrams showing intensity distribution of the electric field generated by the antenna device in a plane parallel to the X- and Y-axes.
Figure 6B:
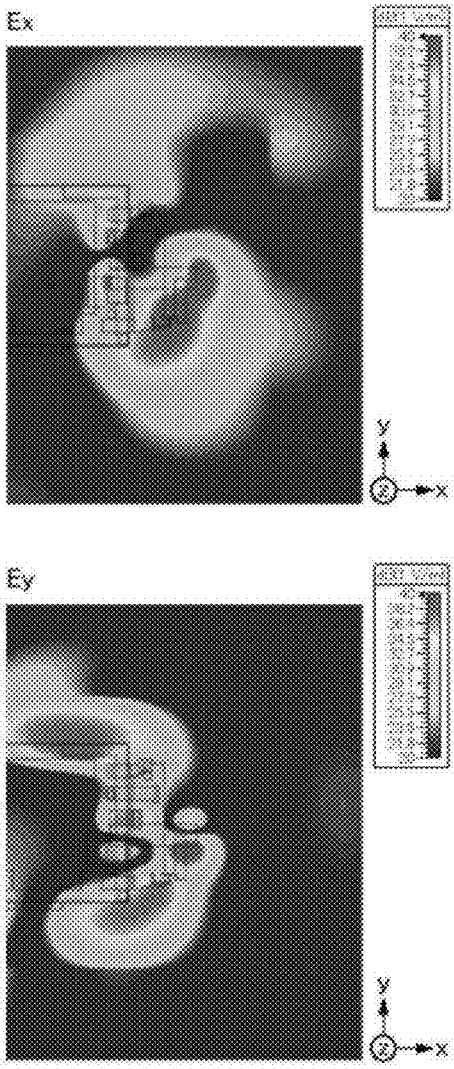
Figure 7A:
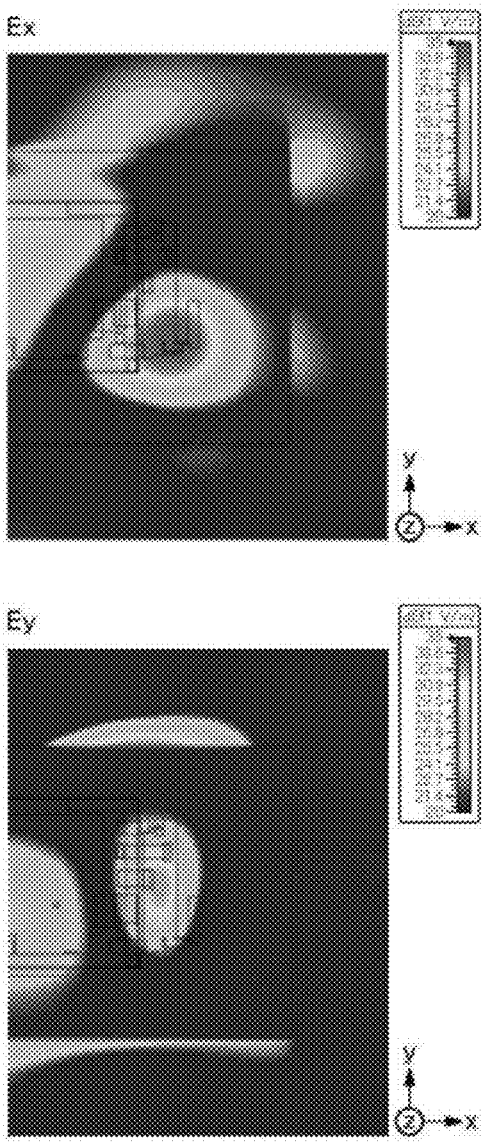
FIGS. 7A and 7B are diagrams showing intensity distribution of the electric field generated by the antenna device in a plane parallel to the X- and Y-axes.
Figure 7B:
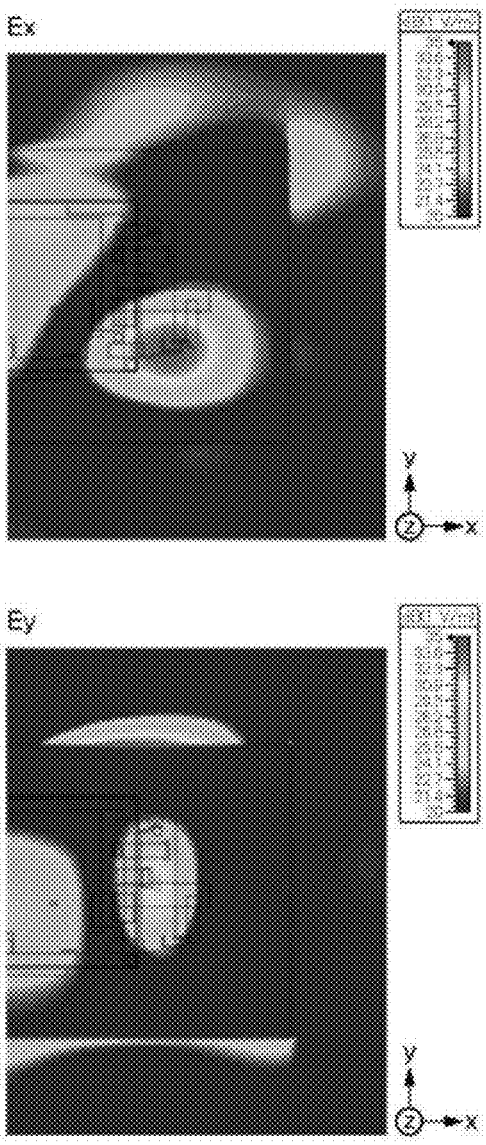

The guard conductor 30 is disposed near this area. As described above, a charge inside the guard conductor 30 moves depending on the electric fields Ex and Ey generated by the radiation conductor 10 and thereby the electric field distribution is scattered to the outer periphery of the conductor. Specifically, as shown in FIG. 5B, by the guard conductor 30, the electric field Ex is dispersed and diffused to left and right both sides of the guard conductor 30 and the electric field Ey is dispersed and diffused to upper and lower both sides.

Figure 8B:
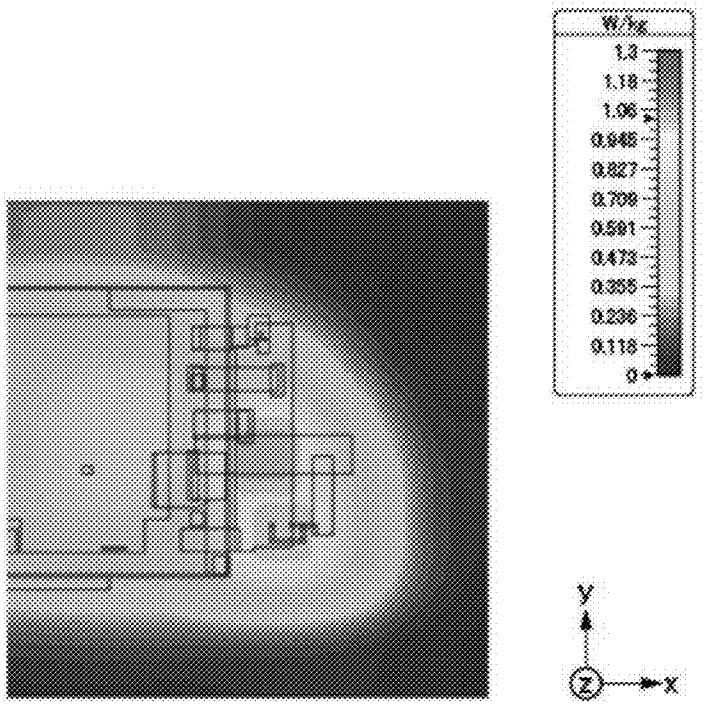
FIGS. 8A and 8B are diagrams showing calculation results of a local SAR.
Figure 8A:
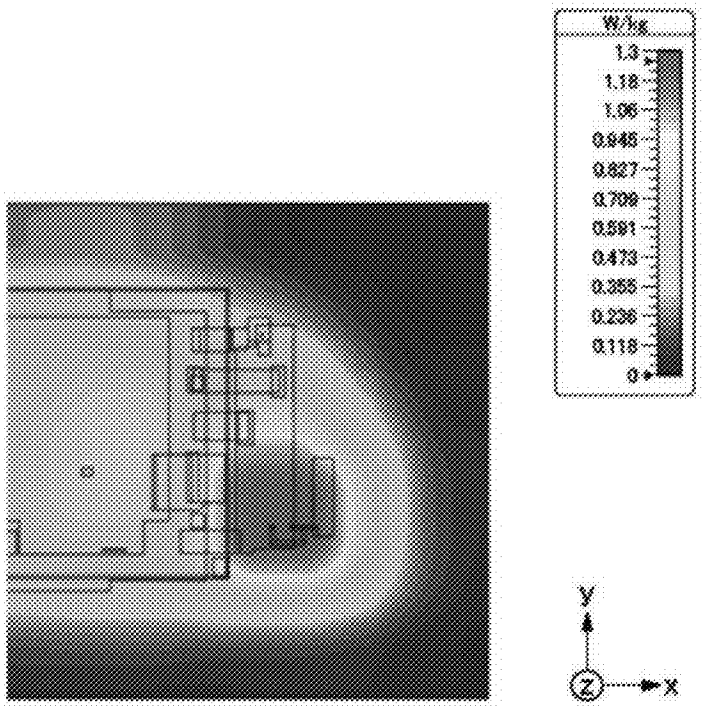

FIGS. 8A and 8B are diagrams showing calculation results of the local SAR. Due to the effect of the diffusion of the near field by the guard conductor 30 shown in FIG. 5B, the value of the SAR can be reduced by about 20% substantially.

Figure 9A:
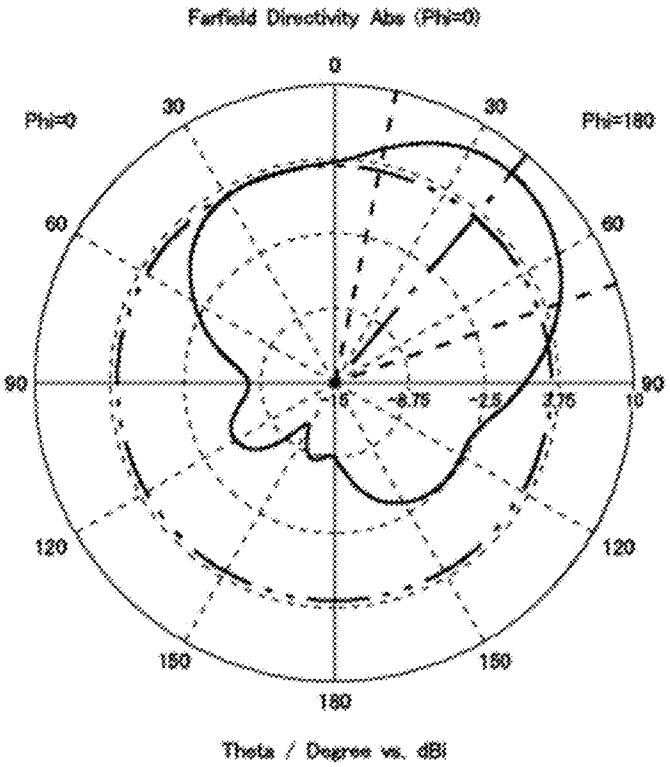
FIGS. 9A and 9B are diagrams showing calculation results of the directionality of the antenna device.
Figure 9B:
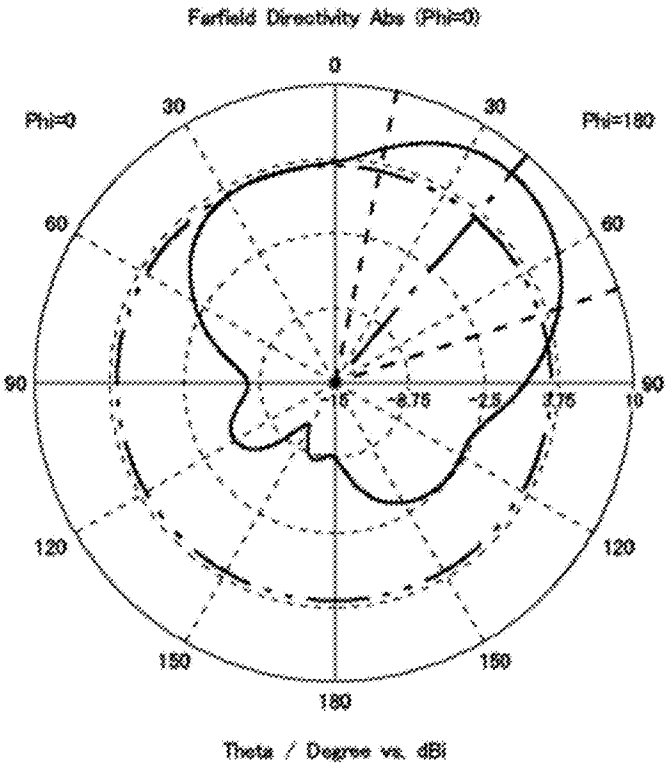

FIGS. 9A and 9B are diagrams showing calculation results of the directionality of the antenna device 2. FIG. 9A shows the directionality when the guard conductor 30 is not provided and FIG. 9B shows that when the guard conductor 30 is provided. As is understood from comparison between FIGS. 9A and 9B, it is shown that the directionality of the antenna device 2 is hardly affected by the guard conductor 30. That is, it is theoretically explained that the guard conductor 30 cancels out only the near field, which is dominant for the local SAR, and has no influence on the far field.

By setting the length Lg of the guard conductor 30 shorter than λ/2, coupling with the antenna formed by the radiation conductor 10 and the ground conductor 20 can be avoided. Furthermore, because being electrically independent of the ground conductor 20, the guard conductor 30 does not change the surface current flowing to the ground conductor 20. As a result, the efficiency of the antenna and the directionality of the radiation pattern are not affected by this guard conductor 30.

As above, the antenna device 2 according to the embodiment can suppress the SAR without sacrificing the antenna sensitivity and the directionality.

Subsequently, preferable placement of the guard conductor 30 will be explained.

Figure 10:
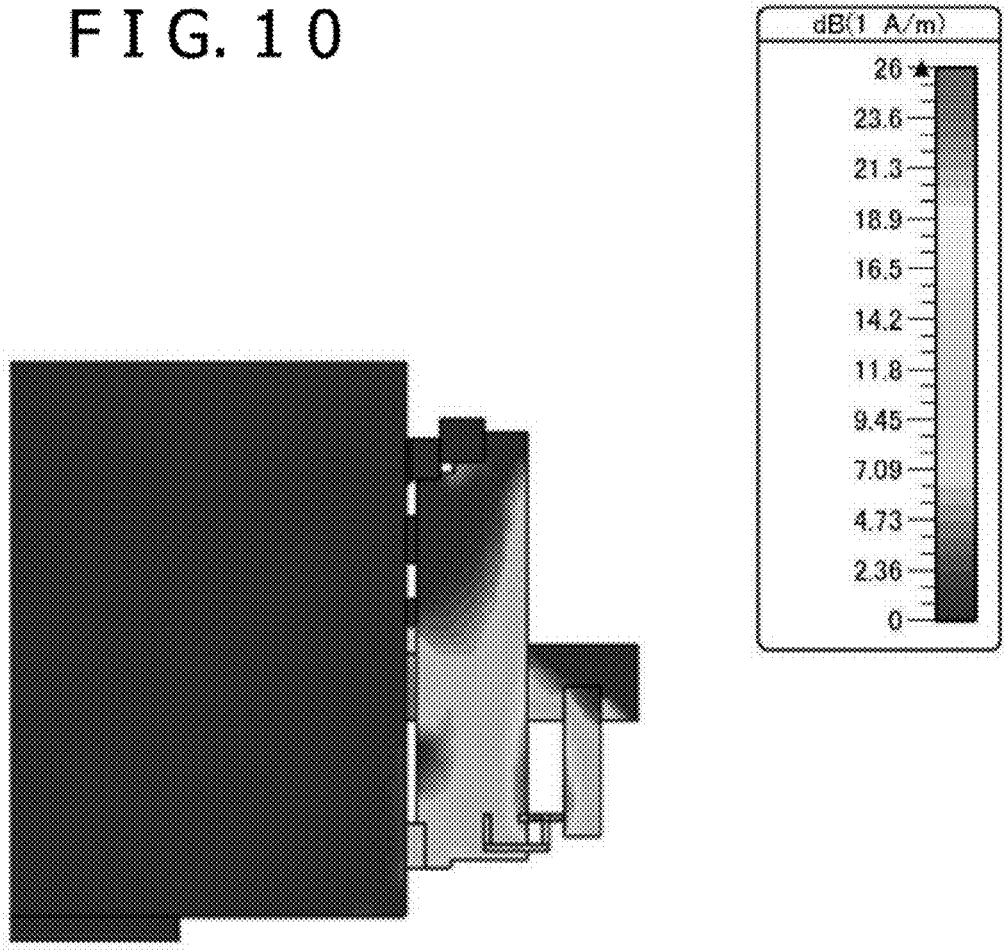
FIG. 10 is a diagram showing the current distribution of the antenna device.

FIG. 10 is a diagram showing the current distribution of the antenna device 2. Comparison between FIG. 10 and FIG. 8A proves that the local SAR is high at a place on which the current concentrates. Specifically, as is apparent from FIG. 10, the current intensity is high along the one side E1 of the ground conductor 20 closest to the feed point 12. Also regarding the radiation conductor 10, the current intensity is high at the part that is near the feed point 12 and opposed to the one side E1. From this, the local SAR can be efficiently lowered by disposing the guard conductor 30 in such a manner that it straddles the one side E1 of the ground conductor 20 closest to the feed point 12.

Figure 11A:
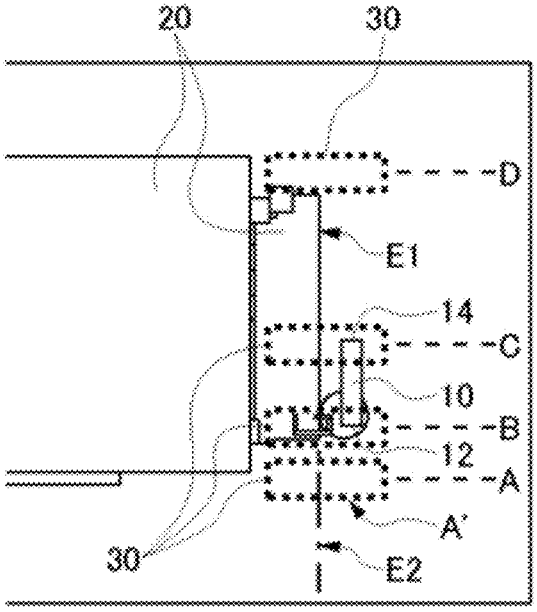
FIG. 11A is a diagram showing a guard conductor disposed at different Y-coordinates.
Figure 11B:
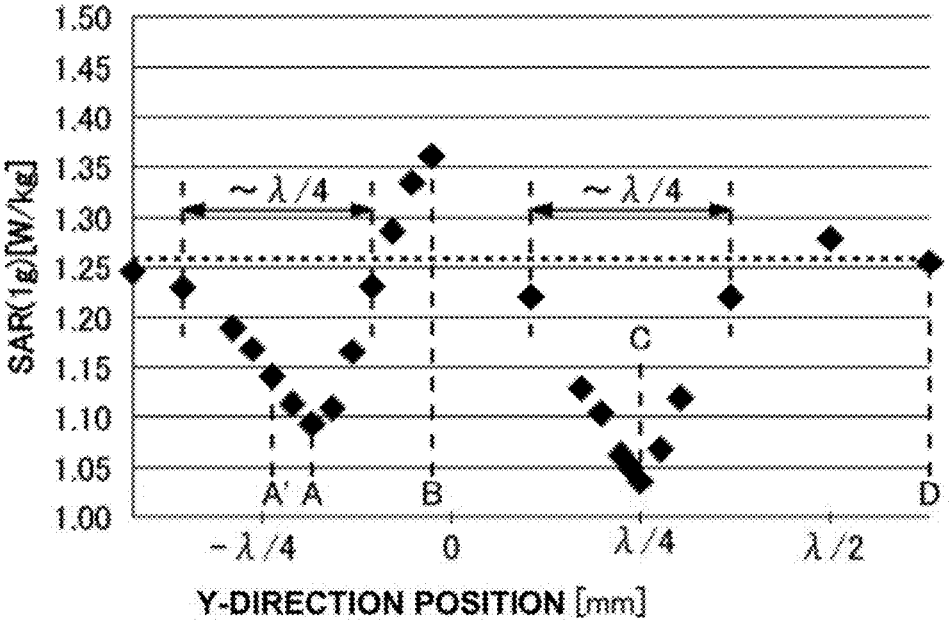
FIG. 11B is a diagram showing the relationship between the Y-coordinate of the guard conductor and the local SAR.

FIG. 11A is a diagram showing the guard conductor 30 disposed at different Y-coordinates and FIG. 11B is a diagram showing the relationship between the Y-coordinate of the guard conductor 30 and the local SAR.

It is when the guard conductor 30 is disposed at a position C near the open end 14 of the radiation conductor 10 that the effect of reduction in the local SAR is the largest. This position C is thought of as a place where the electric waves generated from the antenna is strong. In this simulation, as shown in FIG. 11B, the effect of SAR reduction is achieved in a range of substantially ±λ/8 centered at the position C as the open end 14, i.e. in a width of λ/4. If an error between the model of the antenna device 2 used for the simulation and the actual antenna device 2 (modeling error), an error attributed to a phenomenon that cannot be reproduced in the simulation, and so forth are considered, possibly the effect of SAR reduction can be achieved in a width wider than λ/4 in some cases in the actual antenna device 2. Therefore, the effect of SAR reduction is expected by disposing the guard conductor 30 in a width of λ/2.5 (range of ±λ/5) centered at the open end 14.

On the other hand, the local SAR increases if the guard conductor 30 is disposed at a position B, i.e. in the vicinity of the feed point 12. This is because the vicinity of the feed point 12 is originally a place where the local SAR is strong and therefore disposing the guard conductor 30 in the vicinity thereof causes electric field energy at the other places to be collected to the position B. That is, it is preferable for the guard conductor 30 to be so disposed as to avoid the vicinity of the feed point 12.

Reference to FIG. 11B proves that the effect of reduction in the local SAR is large not only in the vicinity of the position C but also in the vicinity of the position A. Specifically, the effect of SAR reduction is achieved in a range of ±λ/8, i.e. in a width of λ/4, centered at the position A. When the above-described errors are considered, the effect of SAR reduction is expected by disposing the guard conductor 30 in a range of ±λ/5 centered at the position A. That is, the guard conductor 30 can be disposed not only at a position straddling the one side E1 of the ground conductor 20 closest to the feed point 12 but also at a position straddling the virtual extended line E2 thereof.

The position A substantially corresponds with a coordinate A' resulting from symmetric displacement of the position of the open end 14 with respect to the feed point 12. Strictly speaking, because the ground conductor 20 does not exist on the side of the extended line E2, the position A is attracted closer to the guard conductor 30 than the coordinate A'.

That is, it is preferable for the guard conductor 30 to be so disposed as to cover a place where an electric field concentration occurs, i.e. the place C near the open end 14 of the radiation conductor 10, or the vicinity A of the place A' resulting from symmetric displacement of the place C with respect to the feed point 12.

Figure 12:
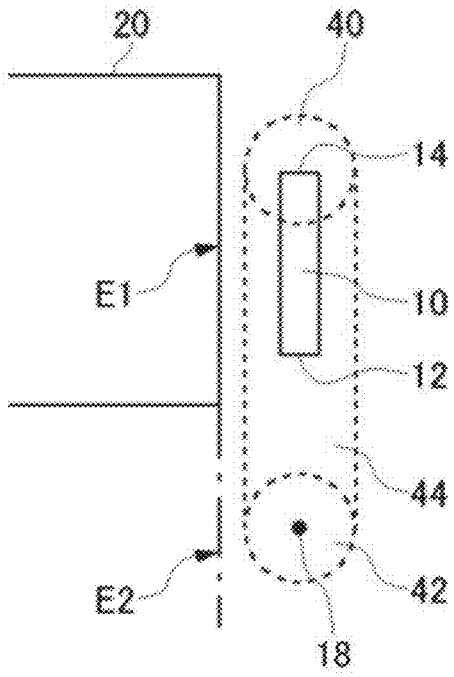
FIG. 12 is a diagram showing preferred placement positions of the guard conductor.

FIG. 12 is a diagram showing preferred placement positions of the guard conductor 30.

As is understood from FIGS. 11A and 11B, it is preferable for the guard conductor 30 to be disposed at such a position that at least part of the guard conductor 30 overlaps with (i) a first area 40 in the vicinity of the open end 14 of the radiation conductor 10, (ii) a second area 42 in the vicinity of a virtual point 18 resulting from symmetric displacement of the open end 14 with respect to the feed point 12, or (iii) part of a third area 44 sandwiched between the first area 40 and the second area 42. The "vicinity" possibly includes a range of about 20% of the wavelength ($\lambda/5$).

More preferably, the guard conductor 30 is disposed at a place where the effect of reduction in the local SAR is achieved in this area 40, 42, or 44, i.e. it is so disposed as to avoid the vicinity of the feed point 12 and the place where the local SAR is the highest.

Summarizing the above, it is preferable for the guard conductor 30 to be so disposed as to overlap with the first area 40 to the third area 44 and straddle the one side E1 (virtual line E2).

Figure 13A:
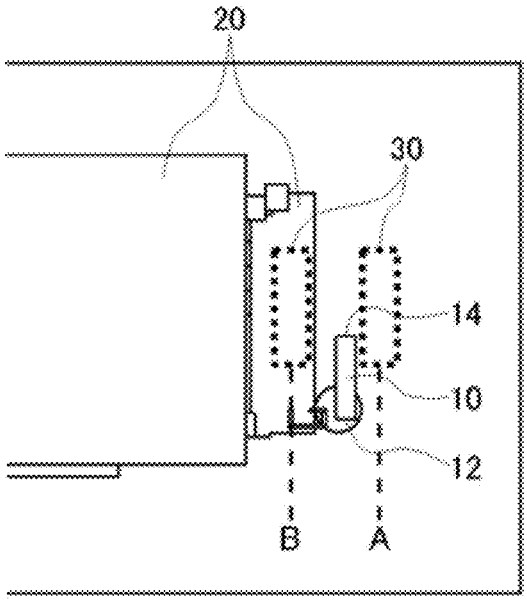
FIG. 13A is a diagram showing the guard conductor disposed at different X-coordinates.
Figure 13B:
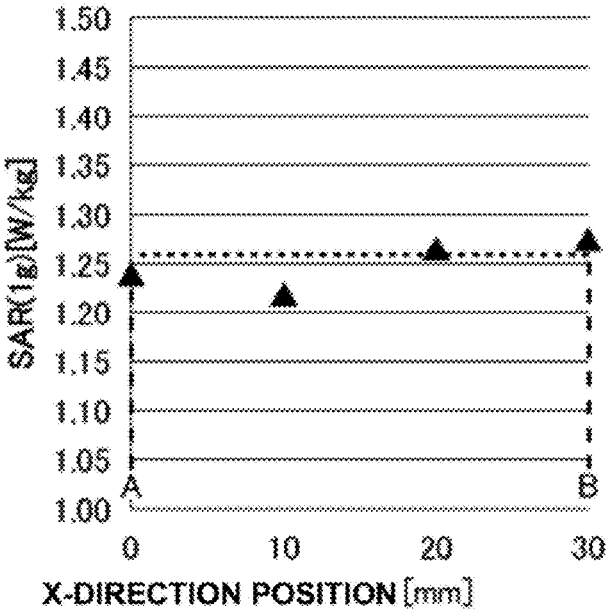
FIG. 13B is a diagram showing the relationship between the X-coordinate of the guard conductor and the local SAR.

FIG. 13A is a diagram showing the guard conductor 30 disposed at different X-coordinates and FIG. 13B is a diagram showing the relationship between the X-coordinate of the guard conductor 30 and the local SAR. The guard conductor 30 in FIG. 13A has a shape whose longitudinal direction is along the one side E1 of the ground conductor 20, at which a current concentration occurs. The guard conductor 30 does not overlap with the one side E1 at a position A and at a position B and the effect of reduction in the local SAR is hardly observed when it is disposed at the position A or B. Also from this, it can be said that it is preferable for the guard conductor 30 to be so disposed as to overlap with the one side E1 (or extended line E2 thereof) and it is preferable for the shape of the guard conductor 30 to have a sufficient length along the direction perpendicular to the one side E1. That is, it is preferable for the guard conductor 30 to have a rectangular shape having a long side along the direction perpendicular to (at 90 degrees) the one side E1.

Alternatively, the guard conductor 30 may be so disposed as to form a predetermined angle larger than or smaller than 90 degrees with the one side E1. For example, the predetermined angle may be 30 degrees to 150 degrees.

The above is the description of the embodiment of the present disclosure. It will be understood by those skilled in the art that this embodiment is exemplification and various modification examples can be made for combinations of the respective constituent elements and the respective processing processes of the embodiment and such modification examples are also within the range of the present disclosure. Such modification examples will be described below.

Figure 14A:
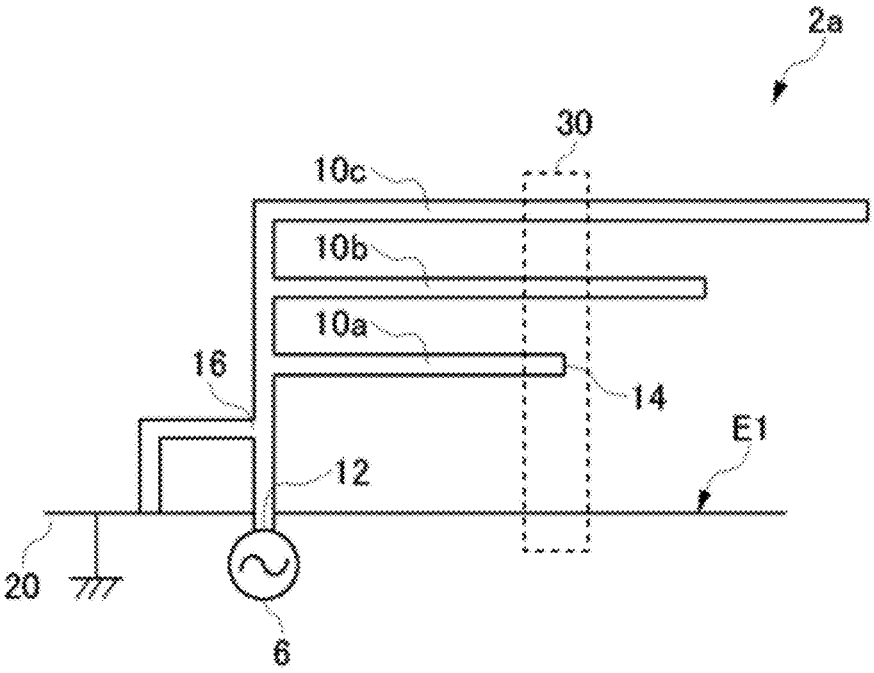
FIGS. 14A and 14B are diagrams showing an antenna device capable of transmitting and receiving radio waves of plural wavelengths $\lambda_1$ to $\lambda_3$.
Figure 14B:
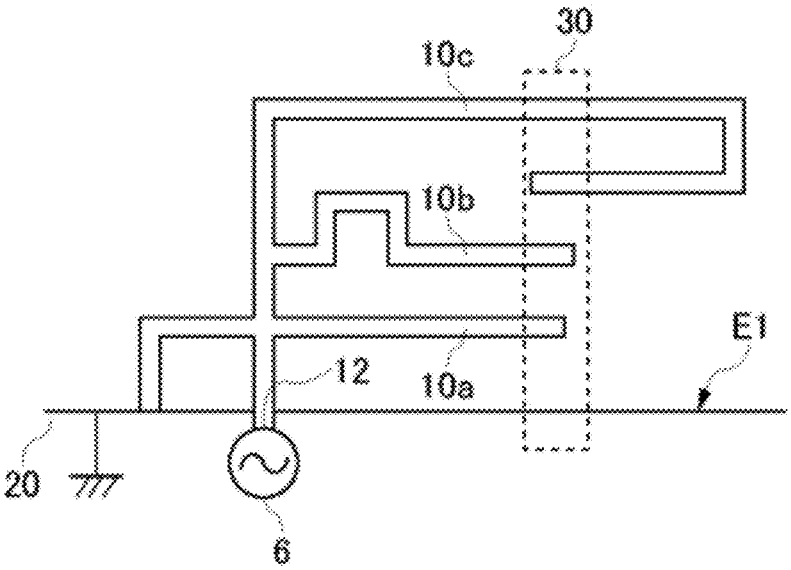

Although the antenna device 2 that transmits and receives radio waves of a single wavelength is described in the embodiment, the present disclosure is not limited thereto. FIGS. 14A and 14B are diagrams showing antenna devices capable of transmitting and receiving radio waves of plural wavelengths $\lambda_1$ to $\lambda_3$ (suppose that $\lambda_1<\lambda_2<\lambda_3$). An antenna device 2*a* includes plural radiation conductors 10*a* to 10*c* corresponding to the plural wavelengths $\lambda 1$ to $\lambda_3$. Each radiation conductor 10 has a length equal to ¼ of the corresponding wavelength. The guard conductor 30 is provided for the radiation conductor 10 that radiates an electric field with the shortest wavelength $\lambda_1$, i.e. the shortest radiation conductor 10*a*. That is, the length Lg of the guard conductor 30 is so designed as to be shorter than $\lambda_1/2$ and the guard conductor 30 is so disposed as to overlap with the vicinity area of the open end 14 of the radiation conductor 10*a*.

In general, the SAR easily becomes a problem with electromagnetic waves of a short wavelength. Furthermore, if the shortest wavelength $\lambda_1$ is employed as the basis and the length Lg of the guard conductor 30 is so designed as to be shorter than $\lambda_1/2$, also regarding the other wavelengths $\lambda_2$ and $\lambda_3$, the length Lg of the guard conductor 30 satisfies relationships of $Lg<\lambda_2/2$ and $Lg<\lambda_3/2$. Therefore, the guard conductor 30 has no influence on radio waves of long wavelengths, with which the SAR becomes a problem less easily.

However, actually, in a situation in which the guard conductor 30 is not disposed, possibly the criterion of the SAR is met with the shortest wavelength and the local SAR does not meet the criterion with another longer wavelength. In this case, the guard conductor 30 may be designed for the radiation conductor 10 corresponding to the wavelength that does not meet the criterion.

If the plural radiation conductors 10*a* to 10*c* are provided, the shape of the radiation conductor 10 may be so designed that the guard conductor 30 overlaps with the open ends 14 of the plural radiation conductors 10 as shown in FIG. 14B. This can reduce the SAR regarding plural wavelengths.

Although the electronic apparatus 100 with which the specific site is a thigh is described in the embodiment, the present disclosure is not limited thereto. For example, with a smartphone, the front surface S1 of the chassis 102 is in contact with or close to a temporal region of the user in a telephone call as one use form. That is, the specific site is the temporal region and the SAR of radiation from the front surface S1 of the chassis to the temporal region should be suppressed. In the case of such electronic apparatus 100, the guard conductor 30 is disposed at a position closer to the temporal region than the radiation conductor 10 in the use form at the time of a telephone call.

With a controller of game apparatus, a smartphone, or mobile game apparatus, possibly the SAR about a hand grasping it becomes a problem in some cases. That is, the specific site is the hand. In such electronic apparatus 100, the guard conductor 30 is disposed at a position close to the user's hand than the radiation conductor 10 in a state in which the user grasps a predetermined place of the electronic apparatus 100 in a certain use form.

With a wearable device used in a state of being mounted on the user's body, the mounting place of the user is the specific site.

The present disclosure contains subject matter related to that disclosed in Japanese Priority Patent Application JP 2013-124974 filed in the Japan Patent Office on Jun. 13, 2013, the entire content of which is hereby incorporated by reference.

What is claimed is:

1. An antenna device comprising:

a ground conductor;

a radiation conductor configured to have a feed point; and a guard conductor configured to be insulated from the ground conductor and be disposed at a position that is closer to a specific site of a user than the radiation conductor in one use form and straddles one side of the ground conductor closest to the feed point or a virtual extended line of the one side;

wherein the guard conductor is disposed at such a position that the guard conductor does not overlap with the feed point and at least part of the guard conductor overlaps with one of a first area in vicinity of an open end of the radiation conductor, a second area in vicinity of a virtual point resulting from symmetric displacement of the open end with respect to the feed point, and a third area sandwiched between the first area and the second area.

2. The antenna device according to claim 1, wherein length of a long side of the guard conductor is shorter than $\lambda/2$ when wavelength of an electric field radiated from the antenna device is defined as $\lambda$.

3. The antenna device according to claim 1, wherein when wavelength of an electric field radiated from the antenna device is defined as $\lambda$, the guard conductor is disposed at such a position that at least part of the guard conductor overlaps with part of a range with a radius of $\lambda/5$ centered at the open end of the radiation conductor.

4. The antenna device according to claim 1, wherein when wavelength of an electric field radiated from the antenna device is defined as $\lambda$, the guard conductor is disposed at such a position that at least part of the guard conductor overlaps with part of a range with a radius of $\lambda/5$ centered at a virtual point resulting from symmetric displacement of the open end with respect to the feed point.

5. The antenna device according to claim 1, wherein when one surface of a chassis of electronic apparatus equipped with the antenna device is close to or in contact with the specific site in the one use form, distance between the guard conductor and the radiation conductor along a direction perpendicular to the one surface is at most $\lambda/(2\pi)$.

6. The antenna device according to claim 1, wherein the guard conductor has a long side along a direction perpendicular to the one side.

7. The antenna device according to claim 1, comprising a plurality of radiation conductors, wherein the guard conductor is provided for the radiation conductor that radiates an electric field with shortest wavelength.

8. The antenna device according to claim 1, wherein the guard conductor is formed of a copper sheet.

9. The antenna device according to claim 1, wherein the guard conductor is formed of paint on a chassis of electronic apparatus equipped with the antenna device.

10. The antenna device according to claim 1, wherein the guard conductor is formed of a human body detection sensor pad mounted on electronic apparatus equipped with the antenna device.

11. The antenna device according to claim 1, wherein the guard conductor is formed of a heat release component mounted on electronic apparatus equipped with the antenna device.

12. An antenna device comprising:

a ground conductor;

a radiation conductor configured to have a feed point; and a guard conductor configured to be insulated from the ground conductor and be disposed at a position that is closer to a specific site of a user than the radiation conductor in one use form and is such a position that at least part of the guard conductor overlaps with a place where intensity of an electric field radiated from the radiation conductor is high;

wherein the position is such that the guard conductor does not overlap with the feed point and at least part of the guard conductor overlaps with one of a first area in vicinity of an open end of the radiation conductor, a second area in vicinity of a virtual point resulting from symmetric displacement of the open end with respect to the feed point, and a third area sandwiched between the first area and the second area.

13. Electronic apparatus comprising an antenna device including:

a ground conductor;

a radiation conductor configured to have a feed point; and a guard conductor configured to be insulated from the ground conductor and be disposed at a position that is closer to a specific site of a user than the radiation conductor in one use form and straddles one side of the ground conductor closest to the feed point or a virtual extended line of the one side;

wherein the position is such that the guard conductor does not overlap with the feed point and at least part of the guard conductor overlaps with one of a first area in vicinity of an open end of the radiation conductor, a second area in vicinity of a virtual point resulting from symmetric displacement of the open end with respect to the feed point, and a third area sandwiched between the first area and the second area.

14. An antenna device comprising:

a ground conductor;

a radiation conductor configured to have a feed point;

a guard conductor configured to be insulated from the ground conductor and be disposed at a position that is closer to a specific site of a user than the radiation conductor in one use form and straddles one side of the ground conductor closest to the feed point or a virtual extended line of the one side; and a plurality of radiation conductors, wherein the guard conductor is provided for the radiation conductor that radiates an electric field with shortest wavelength.

* * * * *